US005183229A

United States Patent [19]

Duggan

[11] Patent Number: 5,183,229

[45] Date of Patent: Feb. 2, 1993

[54] BABY BOTTLE HOLDER

[76] Inventor: Michael D. Duggan, 92-523 Kokole St., Makakilo, Hi. 96707

[21] Appl. No.: 805,633

[22] Filed: Dec. 12, 1991

[51] Int. Cl.[5] ..... A47D 15/00

[52] U.S. Cl. ..... 248/102; 215/11.1

[58] Field of Search ..... 248/102, 103, 105, 106; 215/11.1, 100 R; 220/94 R; D24/45, 46, 47, 48

[56] References Cited

U.S. PATENT DOCUMENTS

| | | | |
|---|---|---|---|
| 3,055,525 | 9/1962 | Coleman | 215/11.1 |
| 4,796,767 | 1/1989 | McKeown | 215/11.1 |
| 4,799,636 | 1/1989 | Johnson | 248/102 |
| 4,815,615 | 3/1989 | Phlaphongphanich | 215/11.1 |
| 4,984,697 | 1/1991 | Kelly | 215/11.1 |
| 5,044,509 | 9/1991 | Petrosky | 215/11.1 X |
| 5,072,843 | 12/1991 | James | 248/102 X |

FOREIGN PATENT DOCUMENTS

| | | | |
|---|---|---|---|
| 637337 | 2/1962 | Canada | 248/102 |
| 2238248 | 5/1991 | United Kingdom | 215/11.1 |

*Primary Examiner*—J. Franklin Foss
*Attorney, Agent, or Firm*—Michael I. Kroll

[57] ABSTRACT

A holder is provided for a baby bottle of the type having a body, a cap and a nipple. The holder consists of a mechanism for retaining the body of the baby bottle. The baby bottle will remain stationary, when the retaining mechanism with the baby bottle is placed onto a mattress in a crib or the like near a mouth of a baby, allowing the baby to always have access to the nipple for feeding.

5 Claims, 1 Drawing Sheet

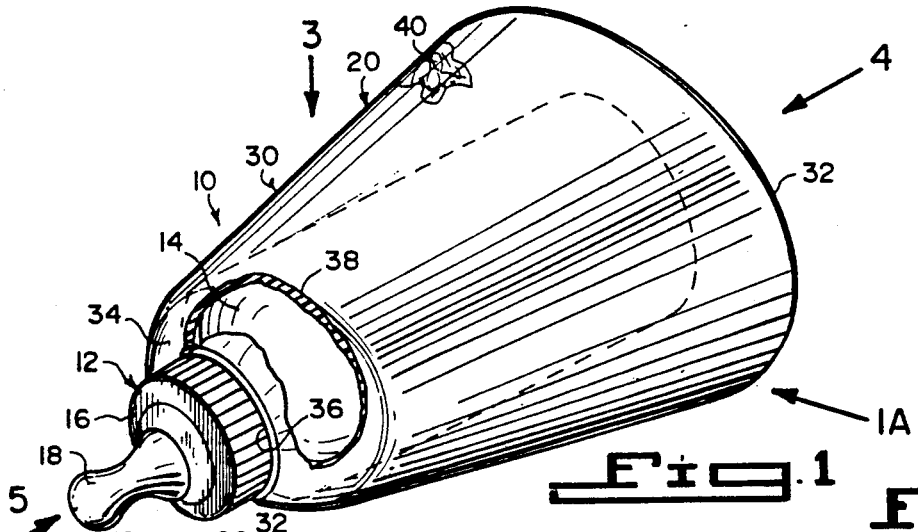
Fig. 1
Fig. 2
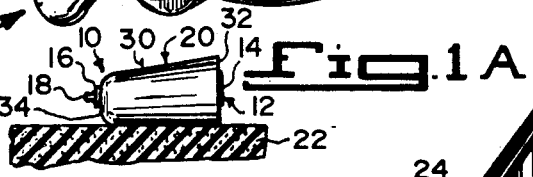
Fig. 1A
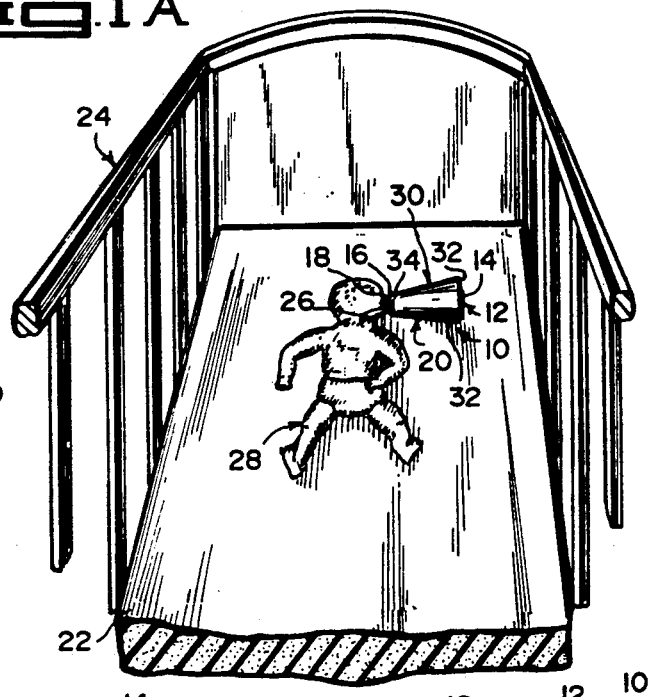
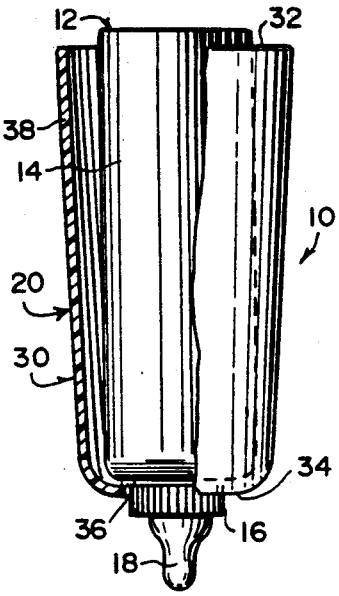
Fig. 3
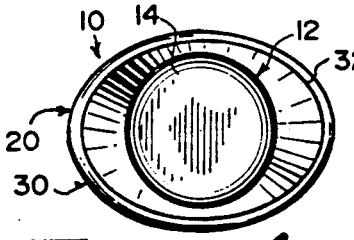
Fig. 4
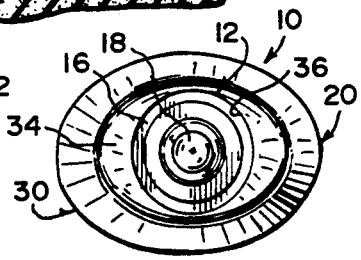
Fig. 5

BABY BOTTLE HOLDER

BACKGROUND OF THE INVENTION

1. Field of the Invention

The instant invention relates generally to feeding equipment for infants and more specifically it relates to a baby bottle holder.

2. Description of the Prior Art

Numerous feeding equipment for infants have been provided in prior art that are adapted to include baby bottles with nipple to help feed various nutritious liquids to the infants. Most people use some object to prop up the bottle in the crib, but the bottle never stays put and rolls away. While these units may be suitable for the particular purpose to which they address, they would not be as suitable for the purposes of the present invention as heretofore described.

SUMMARY OF THE INVENTION

A primary object of the present invention is to provide a baby bottle holder that will overcome the shortcomings of the prior art devices.

Another object is to provide a baby bottle holder that will retain the baby bottle, so that it will remain stationary when placed into a crib near a baby allowing the baby to always have access to the nipple of the bottle.

An additional object is to provide a baby bottle holder which is a tapered oval sleeve that retains the bottle therein, with the nipple extending therefrom, so that the baby can always feed from the bottle when the holder is placed adjacent the baby.

A further object is to provide a baby bottle holder that is simple and easy to use.

A still further object is to provide a baby bottle holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the instant invention with parts broken away retaining a baby bottle therein.

FIG. 1A is a side view taken in direction of arrow 1A in FIG. 1, showing the instant invention positioned on a mattress.

FIG. 2 is a perspective view of a crib with parts broken away, showing a baby therein utilizing the instant invention.

FIG. 3 is a top view with parts broken away taken in direction of arrow 3 in FIG. 1. FIG. 4 is a rear end view taken in direction of arrow 4 in FIG. 1.

FIG. 5 is a front end view taken in direction of arrow 5 in FIG. 1.

DETAILED DESCRIPTION OF THE PREFERRED EMBODIMENTS

Turning now descriptively to the drawings, in which similar reference characters denote similar elements throughout the several views, the Figures illustrate a holder 10 for a baby bottle 12 of the type having a body

14, a cap 16 and a nipple 18. The holder 10 consists of a mechanism 20 for retaining the body 14 of the baby bottle 12. The baby bottle 12 will remain stationary, when the retaining mechanism 20 with the baby bottle 12 is placed onto a mattress 22 in a crib 24 or the like near a mouth of a baby 28, allowing the baby 28 to always have access to the nipple 18 for feeding.

The retaining mechanism 20 includes an oval shaped sleeve 30 with a wide opened rear end 32 for insertion of the body 14 of the baby bottle therein and a narrow front end 34 having a circular aperture 36 thereabout. The cap 16 and the nipple 18 of the baby bottle 12 can extend through the circular aperture 36 with the oval shaped sleeve 30, preventing the baby bottle 12 from rolling away from the mouth 26 of the baby 12.

The oval shaped sleeve 30 is tapered forward towards the circular aperture 36, so that the body 14 of the baby bottle will be lifted to slant forward, allowing the fluid within the body 14 to flow towards the nipple 18 for proper feeding of the baby 28. The oval shaped sleeve 30 is fabricated out of a thin plastic material 38 which can be of the same plastic material used in making the body 14 of the baby bottle 12. The thin plastic material 38 can be transparent, so that a person can see through the oval shaped sleeve 30 and into the body 14 of the baby bottle 12 to see how much of the fluid within the body 14 of the baby bottle 12 is left after the baby 28 feeds.

The thin plastic material 38 of the oval shaped sleeve 30 can further include a pattern 40 thereon, such as stars, stripes, various pictures, various colors and the like to enhance the appearance of the holder 10, when used in conjunction with the baby bottle 12.

When a person wants to feed the baby 28, they place the baby bottle 2 into the oval shaped sleeve 30. They then place the holder 10 flat on the mattress 22 to the side of the mouth 26 of the baby 28. The baby 28 can now turn its head sideways and feed without loosing the baby bottle 12, since the oval shaped sleeve 30 will hold the baby bottle 12 stationary and tilted forward, so that all the fluid within the body 14 can be consumed.

LIST OF REFERENCE NUMBERS

10—holder
12—baby bottle
14—body
16—cap
18—nipple
20—retaining mechanism
22—mattress
24—crib
26—mouth
28—baby
30—oval shaped sleeve
32—wide opened rear end of 30
34—narrow front end of 30
36—circular aperture in 34
38—thin plastic material
40—pattern on 30

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A holder for a baby bottle of the type having a body, a cap and a nipple, said holder comprising means for retaining the body of the baby bottle, so that the baby bottle will remain stationary, when said retaining means with the baby bottle is placed onto a mattress in a crib or the like near a mouth of a baby, allowing the baby to always have access to the nipple for feeding, said retaining means includes an oval shaped sleeve, not just irregular but specifically oval shaped, with a wide opened rear end for insertion of the body of the baby bottle therein and a narrow front end having a circular aperture thereabout, so that the cap and nipple of the baby bottle can extend through said circular aperture, with said oval shaped sleeve preventing the baby bottle from rolling away from the mouth of the baby.

2. A holder for a baby bottle as recited in claim 1, wherein said oval shaped sleeve is tapered forward towards said circular aperture, so that the body of the baby bottle will be lifted to slant forward, allowing the fluid within the body to flow towards the nipple for proper feeding of the baby.

3. A holder for a baby bottle as recited in claim 2, wherein said oval shaped sleeve is fabricated out of a thin plastic material, which can be of the same plastic material used in making the body of the baby bottle.

4. A holder for a baby bottle as recited in claim 3, wherein said thin plastic material is transparent, so that a person can see through said oval shaped sleeve and into the body of the baby bottle to see how much of the fluid within the body of the baby bottle is left after the baby feeds.

5. A holder for a baby bottle as recited in claim 3, wherein said thin plastic material of said oval shaped sleeve can further include a pattern thereon, such as stars, stripes, various pictures, various colors and the like to enhance the appearance of said holder, when used in conjunction with the baby bottle.

* * * * *